US008814013B2

(12) United States Patent
Almeida Levi

(10) Patent No.: US 8,814,013 B2
(45) Date of Patent: Aug. 26, 2014

(54) FOLDABLE HANGERS

(71) Applicant: Flexhanger LLC, Redwood City, CA (US)

(72) Inventor: Camille Carvalho Monteiro De Almeida Levi, Redwood City, CA (US)

(73) Assignee: Flexhanger, LLC, Redwood City, CA (US)

( * ) Notice: Subject to any disclaimer, the term of this patent is extended or adjusted under 35 U.S.C. 154(b) by 0 days.

(21) Appl. No.: 14/011,742

(22) Filed: Aug. 27, 2013

(65) Prior Publication Data

US 2014/0054333 A1 Feb. 27, 2014

(30) Foreign Application Priority Data

Aug. 27, 2012 (WO) ..... PCT/BR2012/000312

(51) Int. Cl.

*A41D 27/22* (2006.01)
*A47G 25/18* (2006.01)
*A47G 25/40* (2006.01)

(52) U.S. Cl.

CPC ..... *A47G 25/40* (2013.01); *A47G 25/4023* (2013.01); *A47G 25/183* (2013.01)
USPC ..... 223/94

(58) Field of Classification Search

USPC ..... 223/85–97; 211/85.3, 118; D6/324
See application file for complete search history.

(56) References Cited

U.S. PATENT DOCUMENTS

| | | | | | |
|---|---|---|---|---|---|
| 2,611,517 | A * | 9/1952 | Simonsen | 223/88 |
| 2,716,514 | A * | 8/1955 | Braunstein | 223/94 |
| 2,723,065 | A * | 11/1955 | Vargo | 223/94 |
| 2,728,499 | A * | 12/1955 | Mueller | 223/94 |
| 2,881,965 | A * | 4/1959 | Paul | 223/94 |
| 3,531,028 | A * | 9/1970 | Vazquez | 223/94 |
| 5,397,037 | A * | 3/1995 | Ozawa | 223/94 |
| 5,979,721 | A * | 11/1999 | Curtis | 223/94 |
| 8,177,106 | B2 * | 5/2012 | Betts | 223/94 |
| 2006/0226179 | A1 * | 10/2006 | Hsu | 223/85 |
| 2007/0158374 | A1 | 7/2007 | Chan | |

FOREIGN PATENT DOCUMENTS

| | | | |
|---|---|---|---|
| JP | 2003-299565 | A | 10/2003 |
| JP | 2004-167113 | A | 6/2004 |
| JP | 3779897 | B2 | 5/2006 |
| WO | 03-013322 | A1 | 2/2003 |

* cited by examiner

*Primary Examiner* — Ismael Izaguirre
(74) *Attorney, Agent, or Firm* — Jun He Law Offices P.C.; James J. Zhu

(57) ABSTRACT

The present disclosure provides a hanger. The hanger comprises a supporting base, a hooking member, a pair of hanging members and a locking member. The hooking member is operably linked to the supporting base. The pair of hanging members are pivotally mounted to the supporting base and rotatable relative to the supporting base between an expandable mode and a retracted mode. The locking member is operably coupled to the pair of hanging members. The locking member can be locked or unlocked, wherein the pair of hanging members are in the expanded mode when the locking member is locked, and are allowed to be in the retracted mode when the locking member is unlocked.

15 Claims, 8 Drawing Sheets

FOLDABLE HANGERS

TECHNICAL FIELD

The present disclosure generally relates to hanging devices, and more particularly relates to foldable hangers for hanging clothes or accessories.

BACKGROUND

There are various types of clothes hangers available on the market. However, most of the hangers are fixed in structure and made of rigid materials, such as metal, wood or plastics. Also, these hangers take up a lot of space, and therefore may not be suitable for storage within a storage box or suitcase for travel or daily use.

Thus, there is a need for hangers that are flexible to facilitate hanging and accessing clothes and accessories with ease and are convenient to carry or store.

SUMMARY OF THE INVENTION

One aspect of the present disclosure relates to foldable hangers which are convenient to carry, store, or place into/out of clothes with ease.

In certain embodiments, the present disclosure provides a foldable hanger comprising: a supporting base; a hooking member operably linked to the supporting base; a pair of hanging members pivotally mounted to the supporting base and rotatable relative to the supporting base between an expandable mode and a retracted mode; a locking member operably coupled to the pair of hanging members, wherein the locking member can be switchably locked or unlocked (or having a locking position and an unlocking position), and wherein the pair of hanging members is in the extended mode when the locking member is in the locked position, and is allowed to be in the retracted mode when the locking member is in the unlocked position.

When the locking member sets the hanging members in the retracted mode, the hanging members may be folded into a structure that takes up much less space than that in the expanded mode. Thus, when the hanging members are in the retracted mode, the members can be easily placed into the clothes to be hung. Alternatively, when the hanging members are in the extended mode to hang clothes (e.g., a dress or a polo shirt), the locking member can be switched to be in an un-locking position or unlocked so as to render the hanging members change from the extended mode to the retracted mode. As a result, the hanger can be easily taken out of the clothes and vice-versa. In addition, other advantages of the hanger are convenient to carry or store, which is ideal for home use, business use or travel use.

In certain embodiments, each of the pair of hanging members has an inner end received within the supporting base and a notch at the inner end; and the locking member comprises: a pair of locking plates pivotally mounted to the supporting base, each of which has a hook operably inserted into the corresponding notch of the pair of hanging members to prevent the pair of hanging member from rotating relative to the supporting base; and a pair of biasing elements for applying biasing forces to the pair of locking plates to prevent the hooks from releasing from the notches. The engagement between the hooks and notches can firmly retain and lock the hanging members in the expanded mode. Moreover, the design is simple in structure and easy to manufacture and assemble.

In certain embodiments, the inner end of each of the hanging members is at least partially shaped as a curved surface. The curved inner ends help the rotation of the hanging members in the retracted mode.

In certain embodiments, each of the pair of hanging members has at least another notch at the curved surface of its inner end.

In certain embodiments, each of the locking plates has a rotation axis separating two ends thereof, and wherein the hook is positioned at one end of the locking plate, and the biasing element is positioned at the other end of the locking plate.

In certain embodiments, each of the locking plates is configured to release the hooks from the notches in response to driving forces against the respective biasing forces when the locking member is switched from the locked position to the unlocked position.

In certain embodiments, the hanger further comprises: an unlocking member operably coupled to the locking member, and configured to drive the locking member to switch from the locked position to the unlocked position.

In certain embodiments, the unlocking member comprises a pair of unlocking plates operably engaged with the locking member such that their displacements relative to the locking member are converted to a driving force for driving the locking member.

In certain embodiments, the unlocking member further comprises at least one spring for coupling the pair of unlocking plates.

In certain embodiments, the unlocking member further comprises: a rotation member rotatably coupled to the supporting base, and configured to move relative to the locking member through its rotation relative to the supporting base, such that the displacement of the rotation member is converted to a driving force for driving the locking member.

In certain embodiments, the rotation member is threadly coupled to the supporting base.

In certain embodiments, the unlocking member comprises: a button resiliently coupled to the locking member, and configured to linearly move relative to the locking member, such that the displacement of the button is converted to a driving force for driving the locking member.

In certain embodiments, the unlocking member comprises a spring for resiliently coupling the button with the locking member.

In certain embodiments, the unlocking member comprises: a switch movably mounted on the supporting base and a spring for resiliently coupling the switch with the supporting base, such that the displacement of the switch relative to the supporting base is converted to a driving force for driving the locking member.

In certain embodiments, the unlocking member comprises: a button mounted on a lateral side of the supporting base and operably engaged with the locking member such that the displacement of the button relative to the locking member is converted to a driving force for driving the locking member.

In certain embodiments, the hanger further comprises: a side hanging member fixed on a lateral side of the supporting base and configured to hang an object.

In certain embodiments, the side hanging member is positioned in the middle of the supporting base.

The foregoing has outlined, rather broadly, features of the present disclosure. Additional features of the present disclosure will be described, hereinafter, which form the subject of the claims of the present disclosure. It should be appreciated by those skilled in the art that the conception and specific embodiments disclosed herein may be readily utilized as a basis for modifying or designing other structures or processes for carrying out the objectives of the present disclosure. It should also be realized by those skilled in the art that such equivalent constructions do not depart from the spirit and scope of the present disclosure as set forth in the appended claims.

BRIEF DESCRIPTION OF THE DRAWINGS

The aforementioned features and other features of the disclosure will be further described in the following paragraphs by referring to the accompanying drawings and the appended claims. It will be understood that, these accompanying drawing merely illustrate some embodiments in accordance with the present disclosure and should not be considered as limitation to the scope of the present disclosure. Unless otherwise specified, the accompanying drawings need not be proportional, and similar reference characters generally denote similar elements.

DETAILED DESCRIPTION OF ILLUSTRATIVE EMBODIMENTS

The following detailed description refers to the accompanying drawings as a part of the present disclosure. The illustrative embodiments described in the detailed description, the accompanying drawings and the claims are not limiting, and other embodiments may be adopted, or modifications may be made without deviating from the spirit and subject of the disclosure. It should be understood that, the various aspects of the disclosure described and graphically presented herein may be arranged, replaced, combined, divided and designed in many different configurations, and these different configurations are implicitly included in the disclosure.

In the following paragraphs, some specific terms will be used to clearly describe the illustrative embodiments. However, the intent of using these terms is not to limit the scope of protection of this disclosure, the scope of these terms should extend to any equivalent replacements that achieve substantially the same objective in substantially the same way.

Figure 1:
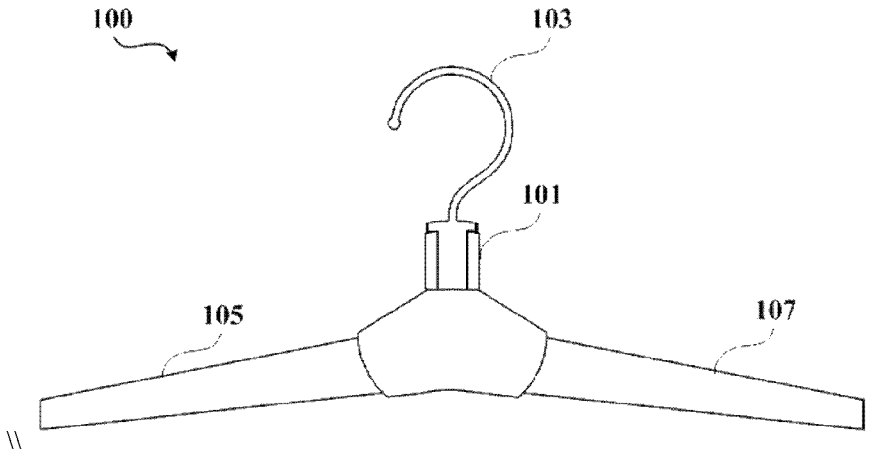
FIGS. 1 and 2 show an exterior view and a perspective view of a hanger 100 in an expanded mode according to an embodiment of the present disclosure, respectively.
Figure 2:
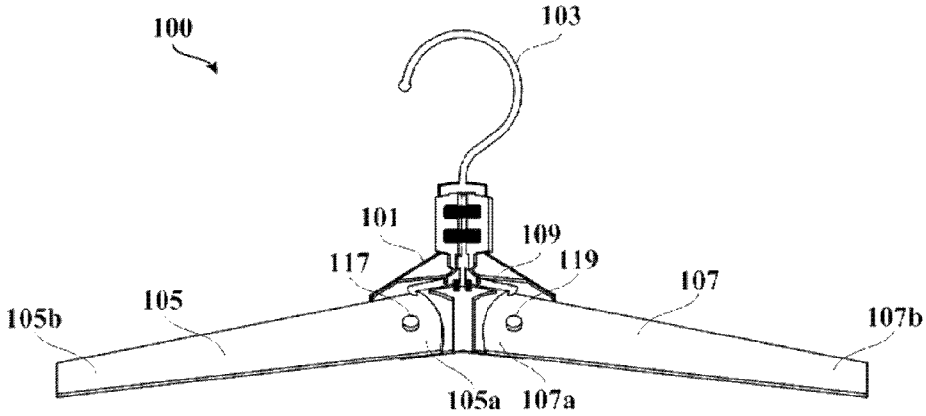

FIGS. 1 and 2 show an exterior view and a perspective view of a hanger 100 in an expanded mode according to an embodiment of the present disclosure, respectively.

As shown in FIGS. 1 and 2, the hanger 100 has a supporting base 101, and a hooking member 103 operably linked to the supporting base 101. The supporting base 101 is used for attaching and supporting the hooking member 103 and some other members of the hanger 100. In certain embodiments, the supporting base 101 may be made of plastics, metal, wood or other suitable materials, which has sufficient strength to support or withstand the weight of a supported object, such as clothes, accessories or the like.

Figure 3:
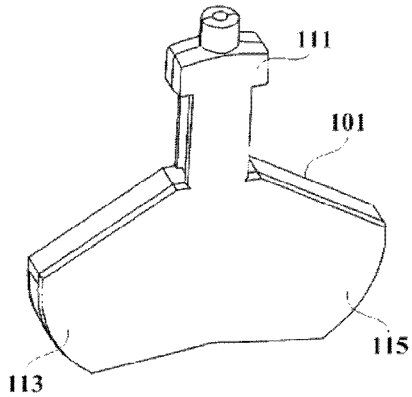
FIG. 3 shows an exemplary structure of a supporting base of the hanger 100 in FIG. 1.

FIG. 3 shows an exemplary structure of the supporting base 101 of the hanger 100 in FIG. 1. As shown in FIG. 3, the supporting base 101 has two triangular plates oppositely connected to each other, such that a cavity is formed within the supporting base 101. The triangular supporting base 101 has an upper angular portion 111 and two lower angular portions 113 and 115. In the embodiment, the upper angular portion 111 has an upward opening for insertion of the hooking member 103 into the cavity of the supporting base 101. In this way, the hooking member 103 is operably linked to the supporting base 101 and may be rotatable in relation to the supporting base 101. In certain embodiments, the hooking member 103 may be otherwise linked to the supporting base 101. For example, the hooking member 103 may be clamped or threaded into the supporting base 101. In some other embodiments, the hooking member 103 may be integrally formed with the supporting base 101. The hooking member 103 may be made of plastics, metal or other suitable material that is easy to shape. In the embodiment shown in FIGS. 1 and 2, the hooking member 103 is shaped like a hook, i.e. curved and sharply bent to be suspended from a rod. In certain embodiments, the hooking member 103 may be shaped as a circle or ring, with its bottom portion attached to the supporting base 101. The circular hooking member 103 may then allow an airing rod or the like to insert therethrough, such that the hanger may be suspended from the airing rod as well. The lower angular portions 113 and 115 also have openings at their ends. It will be appreciated that the supporting base 101 shown in FIG. 3 is merely exemplary and not limiting, the supporting base 101 may vary in shape or structure according to various applications. For example, the supporting base 101 may be formed of a cylindrical shape.

Still referring to FIGS. 1 and 2, the hanger 100 further has a pair of hanging members 105 and 107, which are pivotally mounted to the supporting base 101. The hanging member 105 or 107 may be a long arm having an inner end 105*a* or 107*a* and an outer end 105*b* or 107*b*, which may be bent or straight. The inner ends 105*a* and 107*a* are received within the supporting base 101 through the openings at the lower angular portion 113 and 115 shown in FIG. 3, respectively. The supporting base 101 may have two rotation shafts 117 and 119 to which the inner ends 105*a* and 107*a* are mounted, respectively. The two rotation shafts 117 and 119 are positioned at the two angular lower portions 113 and 115, respectively. In this way, the hanging member 105 or 107 can rotate relative to the supporting base 101, with the outer end 105*b* or 107*b* suspended outside the supporting base 101 to form an approximately horizontal branching structure. The long branching structure is suitable for hanging clothes like shirts, coats, polo shirts or trousers.

With the pivotal coupling between the inner end 105*a* or 107*a* and the rotation shaft 117 or 119, the hanging members 105 and 107 are rotatable relative to the supporting base 101 between the expanded mode and a retracted mode. In the expanded mode shown in FIGS. 1 and 2, the hanging members 105 and 107 are angled at an obtuse angle as designed for shirts or coats. For example, the angle may range from 120 to 179 degrees.

Figure 4:
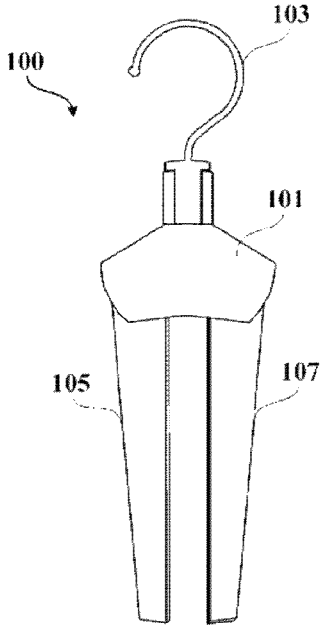
FIGS. 4 and 5 show an exterior view and a perspective view of the hanger 100 in a retracted mode according to an embodiment of the present disclosure, respectively.
Figure 5:
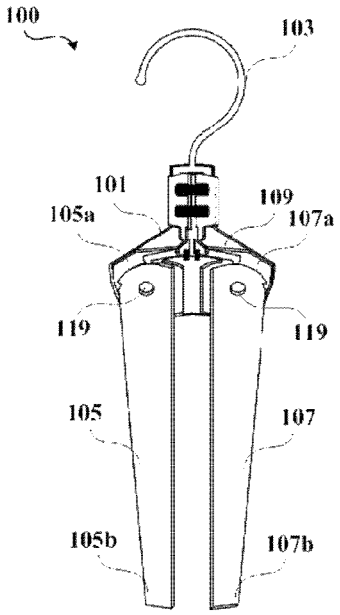

FIGS. 4 and 5 show an exterior view and a perspective view of the hanger 100 in the retracted mode according to an embodiment of the present disclosure, respectively. As shown in FIGS. 4 and 5, the hanging members 105 and 107 are retracted to make their outer ends 105*b* and 107*b* closer to each other. That is, the hanging members 105 and 107 are folded to be approximately parallel with each other. As can be seen from FIGS. 4 and 5, the hanger 100 with its hanging members 105 and 107 retracted in the retracted mode takes up significantly less space than conventional unfoldable hanging devices, and therefore it is more convenient to carry and store for travel or daily use.

The hanger 100 further has a locking member 109, which is operably coupled to the supporting base 101 and the pair of hanging members 105 and 107. The locking member 109 is used to control the rotation of the hanging members 105 and 107. The locking member 109 has switchably a locked position and an unlocked position. The pair of hanging members are positioned at the expanded mode or the retracted mode when the locking member is switched from the locked position to the unlocked position or vice versa. Specifically, when the locking member 109 is in the locked position, the pair of hanging members 105 and 107 are locked in the expanded mode. When the locking member 109 is switched to the unlocked position, the pair of hanging members 105 and 107 are allowed to be in the retracted mode, i.e. to rotate about the rotation shaft 117 and 119, respectively.

Figure 6:
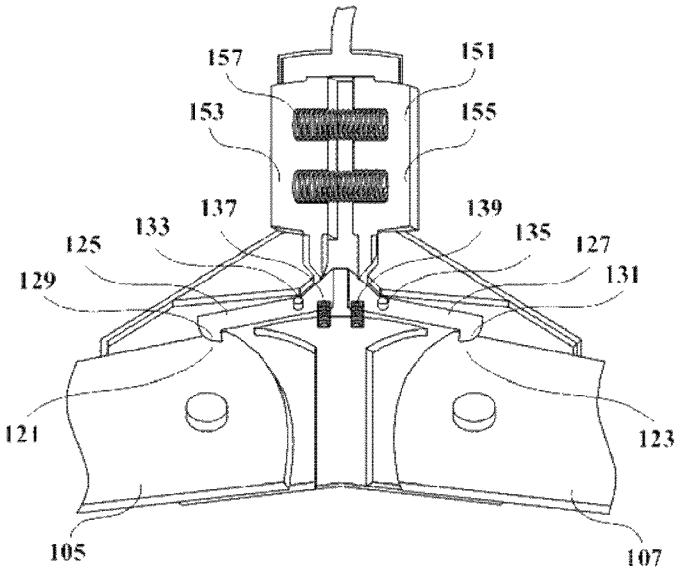
FIGS. 6 and 7 show partially enlarged views of the hanger 100 in the expanded mode and the retracted mode, respectively.
Figure 7:
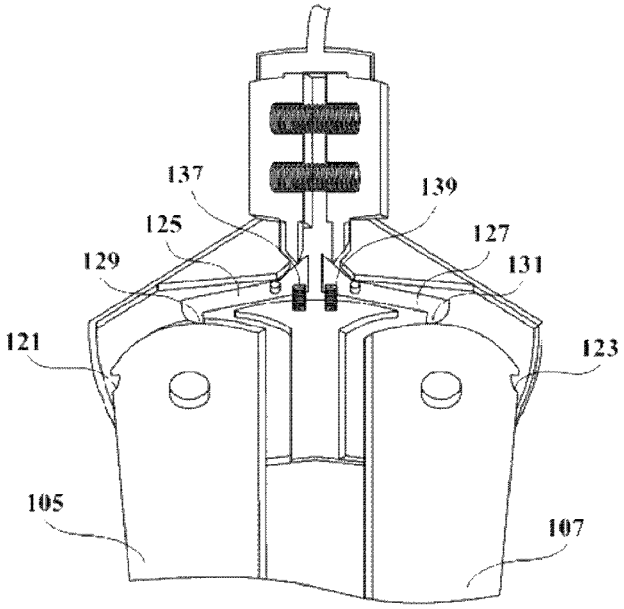

FIGS. 6 and 7 show partially enlarged views of the hanger 100 in the expanded mode and the retracted mode, respectively. As shown in FIGS. 6 and 7, each of the pair of hanging members 105 and 107 has a notch 121 or 123 positioned at their inner ends. The locking member 109 has a pair of locking plates 125 and 127 pivotally mounted to the supporting base 101, each of which has a hook 129 or 131. In particular, the supporting base 101 has a pair of rotation axes 133 and 135 to which the pair of locking plates 125 and 127 are mounted, and the locking plate 125 or 127 can rotate about the rotation axis 133 or 135, respectively. The hook 129 or 131 is operably inserted into the notch 121 or 123 of the pair of hanging members 105 and 107 to prevent the pair of hanging members 105 and 107 from rotating relative to the supporting base 101. The locking member 109 further has a pair of biasing elements 137 and 139, which are used to apply biasing forces to the pair of locking plates 125 and 127 to prevent the hooks 129 and 131 from releasing from the corresponding notches 121 and 123, respectively. In certain embodiments, the biasing elements 137 and 139 may be springs.

With reference to FIG. 6, the rotation axis 133 separates two ends of the locking plate 125, wherein the hook 129 is positioned at one end of the locking plate 125, and the biasing element 137 is positioned at the other end of the locking plate 125. When the hook 129 is inserted into the notch 121, the locking member 109 is in the locked position. Under this condition, the engagement between the notch 121 and the hook 129 keeps the locking plate 125 substantially stable, and thus the rotation of the hanging member 105 is restricted. It will be appreciated that, the hook 129 and the biasing element 137 may be positioned on the same end of the locking plate 125 with respect to the rotation axis 133.

Furthermore, when the locking member 109 is switched from the locked position to the unlocked position, the locking plate 125 releases the hook 129 from the notch 121 in response to a driving force against the biasing force. The driving force may be applied by an unlocking member 151, such as a pair of plates 153 and 155 shown in FIGS. 6 and 7, or some other structures such as a button, rotator, switch or the like.

Specifically, as shown in FIG. 7, when the driving force for unlocking the locking member 109 is applied to the locking plates 125, the locking plate 125 will rotate clockwise (in the direction of FIG. 7) if the driving force exceeds a predefined magnitude equal to the biasing force applied by the biasing element 137. Similarly, the driving force exceeding the predefined magnitude will cause the locking plate 127 to rotate counterclockwise. In this way, the ends of the locking plates 125 and 127 where the hooks reside will move upward to release the hooks from the notches. Then the locking plates 125 and 127 may not restrict the rotation of the hanging members 105 and 107, such that the hanging member 105 or 107 can rotate about the rotation shaft 117 or 119. Thus, the hanging members 105 and 107 will be folded to the retracted mode shown in FIGS. 4 and 5.

In certain embodiments, the inner end of each of the hanging members 105 and 107 may be at least partially shaped as a curved surface, for example, a circular surface. Then the locking plates 125 and 127 may not affect the rotation of the hanging members 105 and 107 when the locking member 109 is unlocked. Furthermore, each of the pair of hanging members 105 and 107 may have at least another notch at the curved surface of its inner end. Thus, the hanging members 105 and 107 may be locked in an intermediately expanded mode. In the intermediately expanded mode, the hanging members 105 and 107 are angled at an angle between the angle associated with the expanded mode and the angle associated with the retracted mode.

As described above, the locking plate 125 is used to release the hook 129 from the notch 121 in response to the driving force against the biasing force. In certain embodiments, the hanger 100 further has the unlocking member 151, which is operably coupled to the locking member 109. The unlocking member 151 is used to drive the locking member 109 to switch from the locked position to the unlocked position.

Still referring to FIG. 6, the unlocking member 151 has a pair of unlocking plates 153 and 155. The unlocking plates 153 and 155 are operably engaged with the locking member 109. For example, the unlocking plates 153 and 155 are operably engaged with the locking plates 125 and 127, respectively. Specifically, the unlocking plate 153 or 155 may be engaged with the locking member 109 if an external force such as a manual operation is applied thereto. The unlocking plate 153 or 155 may be away from the locking member if the external force is removed. The displacement of the unlocking plate 153 or 155 relative to the locking member 109 may be converted to the driving force for driving the locking member 109, which is generally against the biasing force applied by the biasing element 137 or 139. For example, each of the unlocking plate 153 and 155 has a tip, and each of the locking plate 125 and 127 has a sloping surface facing the tip. When the tip moves laterally towards the locking plate 125 or 127, it may press the locking plate 125 or 127 downward via the sloping surface to generate the driving forces against the biasing forces.

In certain embodiments, the unlocking member 151 further has at least one spring 157 for coupling the pair of unlocking plates 153 and 155. The spring 157 may restore the pair of unlocking plates 153 and 155 to a position where they do not apply the driving forces to the locking member 109.

Figure 8:
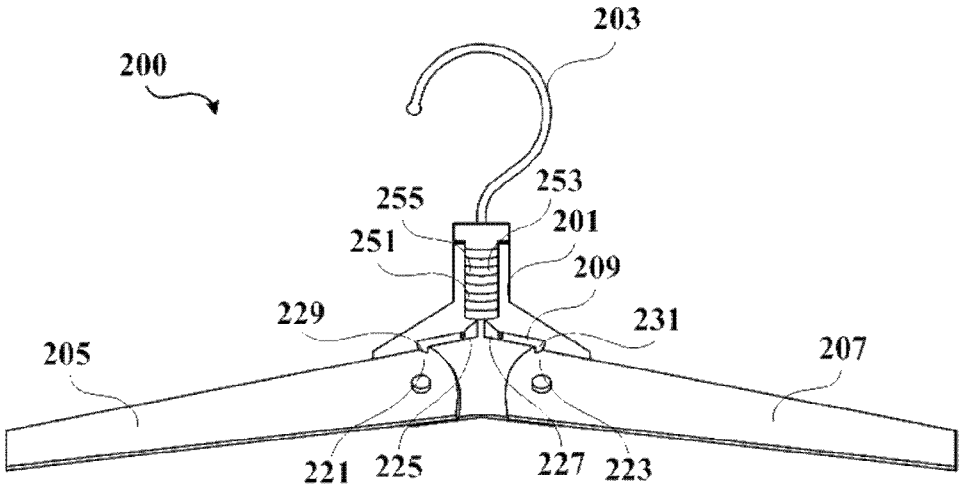
FIGS. 8 and 9 show perspective views of a hanger 200 according to an embodiment of the present disclosure.
Figure 9:
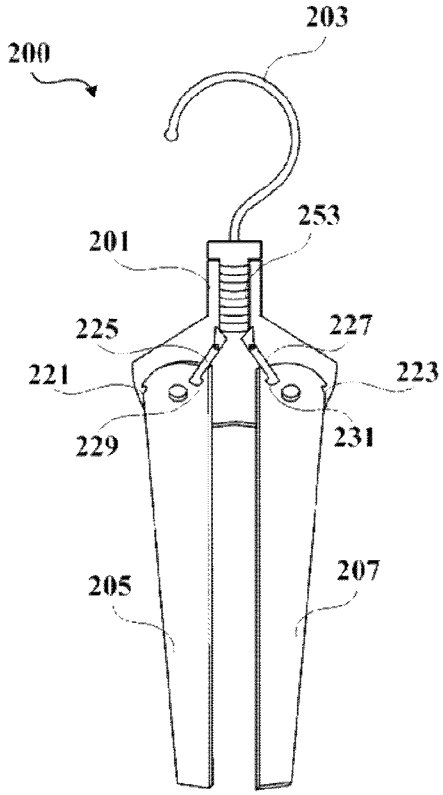

FIGS. 8 and 9 show perspective views of a hanger 200 according to an embodiment of the present disclosure. The hanger 200 shown in FIG. 8 is in an expanded mode, and the hanger 200 shown in FIG. 9 is in a retracted mode.

As shown in FIGS. 8 and 9, the hanger 200 has a supporting base 201, a hooking member 203, a pair of hanging members 205 and 207, a locking member 209 and an unlocking member 251. The locking member 209 has a pair of locking plates 225 and 227, which are biased by a pair of biasing elements (not shown), respectively. The locking plates 225 and 227 may be resiliently coupled with each other, or separately positioned within the supporting base 201.

The unlocking member 251 has a rotation member 253 rotatably coupled to the supporting base 201. For example, the rotation member 253 is threadly coupled to the supporting base 201. The rotation member 253 can move relative to the supporting base 201 and the locking member 209 through its rotation relative to the supporting base 201. In this way, the displacement of the rotation member 253 relative to the locking member 209 is converted to driving force(s) for driving the locking member 209.

Specifically, the rotation member 253 may be a cylindrical insert with an outer thread, and the supporting base 201 has a channel 255 for insertion of the rotation member 253. The hooking member 203 may be secured on the top of the rotation member 253 and moves or rotates with the rotation member 253. The channel 255 has an inner thread mated with the outer thread of the rotation member 253. In this way, the rotation member 253 can move upward or downward in the channel 255, so as to move close to or away from the locking member 209, i.e. the pair of locking plates 225 and 227.

For example, the rotation member 253 may be rotated into the channel 255 and get engaged with the locking plates 225 and 227, thereby the driving forces are applied to the locking plates 225 and 227, respectively. The driving forces may overcome the biasing forces applied by the biasing elements to release hooks 229 and 231 of the locking plates 225 and 227 from notches 221 and 223 of the hanging members 205 and 207, respectively. Then the hanger 200 is switched to the retracted mode as shown in FIG. 9. Moreover, the rotation member 253 may be partially rotated out of the channel 255 to get away from the locking plates 225 and 227. Then the driving forces may be removed from the locking plates 225 and 227. In this way, the biasing forces may restrict the movement of the locking plates 225 and 227 and the hanging members 205 and 207 once the hooks 229 and 231 are received within the respective notches of the hanging members 205 and 207, as shown in FIG. 8.

Figure 10:
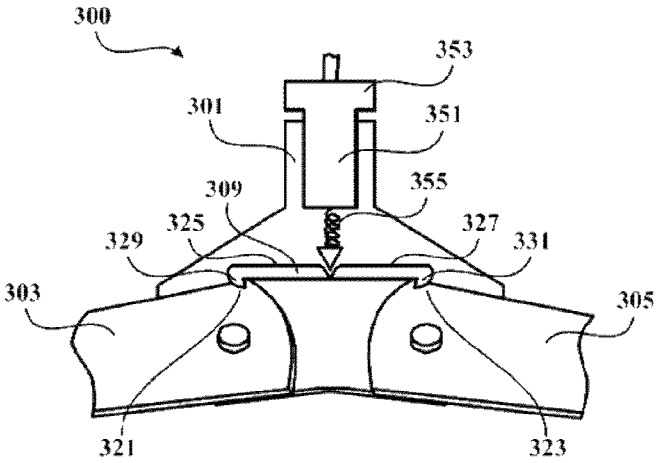
FIGS. 10 and 11 show perspective views of a hanger 300 according to an embodiment of the present disclosure.
Figure 11:
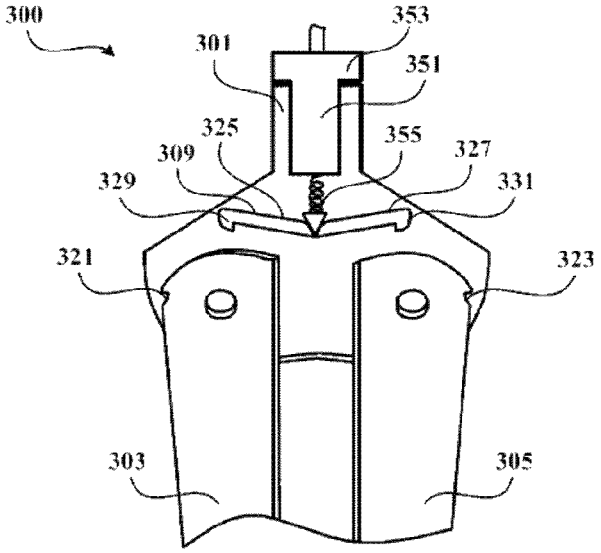

FIGS. 10 and 11 show perspective views of a hanger 300 according to an embodiment of the present disclosure. The hanger 300 shown in FIG. 10 is in an expanded mode, and the hanger 300 shown in FIG. 11 is in a retracted mode.

As shown in FIGS. 10 and 11, the hanger 300 has a supporting base 301, a hooking member (not shown), a pair of hanging members 305 and 307, a locking member 309 and an unlocking member 351. The locking member 309 has a pair of locking plates 325 and 327, which are biased by a pair of biasing elements (not shown), respectively.

The unlocking member 351 has a button 353, which is resiliently coupled to the locking member 309. The button 353 can move with respect to the supporting base 301 and the locking member 309. In this way, the displacement of the button 353 relative to the locking member 309 is converted to driving force(s) for driving the locking member 309.

For example, the unlocking member 351 may further have a spring 355 for resiliently coupling the button 353 with the locking member 309. One end of the spring 355 is connected to the button 353, and the other end of the spring 355 is coupled or connected to the locking member 309, i.e., the locking plates 325 and 327. When the button 353 is pressed into the supporting base 301 and gets closer to the locking member 309, the spring 355 may apply driving forces to the locking plates 325 and 327, respectively. The driving forces may overcome the biasing forces applied by the biasing elements to release hooks 329 and 331 of the locking plates 325 and 327 out of notches 321 and 323 of the hanging members 305 and 307. Then the hanger 300 is switched to the retracted mode as shown in FIG. 11. Moreover, the button 353 may be partially released out of the supporting base 301 and get away from the locking plates 325 and 327. Then the driving forces may be removed from the locking plates 325 and 327. In this way, the biasing forces may restrict the movement of the locking plates 325 and 327 and the hanging members 305 and 307 once the hooks 329 and 331 are received within the respective notches of the hanging members 305 and 307, as shown in FIG. 10.

Figure 12:
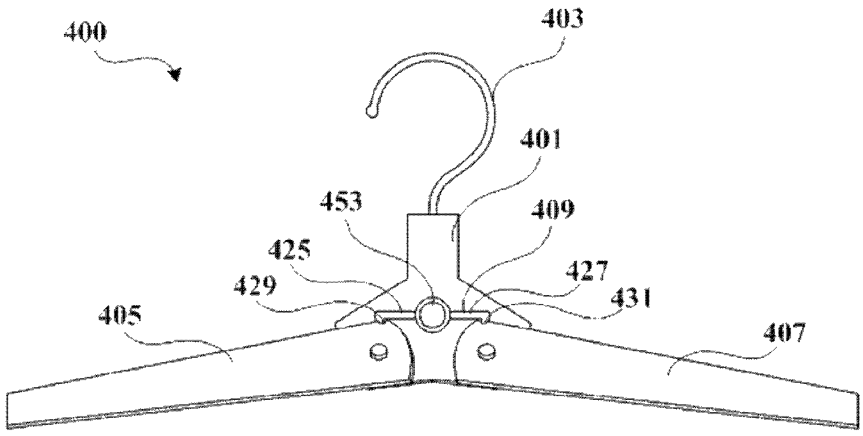
FIGS. 12 and 13 show perspective views of a hanger 400 according to an embodiment of the present disclosure.
Figure 13:
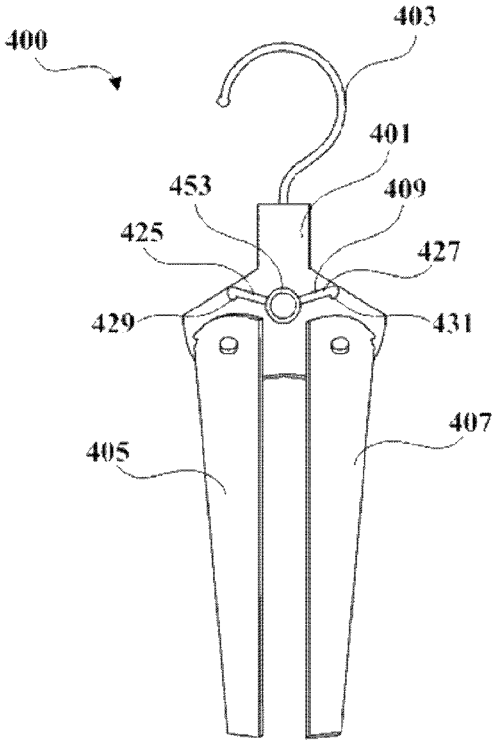

FIGS. 12 and 13 show perspective views of a hanger 400 according to an embodiment of the present disclosure. The hanger 400 shown in FIG. 12 is in an expanded mode, and the hanger 400 shown in FIG. 12 is in a retracted mode.

As shown in FIGS. 12 and 13, the hanger 400 has a supporting base 401, a hooking member 403, a pair of hanging members 405 and 407, a locking member 409 and an unlocking member. The locking member 409 has a pair of locking plates 425 and 427, which are biased by a pair of biasing elements (not shown), respectively.

The unlocking member has a button 453, which is mounted on a lateral side of the supporting base 401 and operably engaged with the locking member 409. The button 453 can move with respect to the supporting base 401 and the locking member 409. In this way, the displacement of the button 453 relative to the locking member 409 is converted to driving force(s) for driving the locking member 409.

For example, the button 453 may has a conical surface operably engaged with the locking member 409. When the button 453 is pressed into the supporting base 401, the conical surface may be engaged with the locking member 409 and drive the engaged end of the locking member 409 downward (in the direction shown in FIG. 13). The driving forces may overcome the biasing forces applied by the biasing element to drive the locking member 409 to the unlocked position. Then the hanger 400 is switched to the retracted mode as shown in FIG. 13.

Moreover, the button 453 may be resiliently coupled to the supporting base, for example, via a spring (not shown). The spring may apply a resilient force to the button 453 to force it away from the locking member 409. In this way, when a force on the button 453 is removed, the button 453 may be partially released out of the supporting base 401 and get away from the locking plates 425 and 427. Then the driving forces may be removed from the locking plates 425 and 427. Thus, the biasing forces may restrict the movement of the locking plates 425 and 427 and the hanging members 405 and 407 once the hooks 429 and 431 are received within the respective notches of the hanging members 405 and 407, as shown in FIG. 12.

Figure 14:
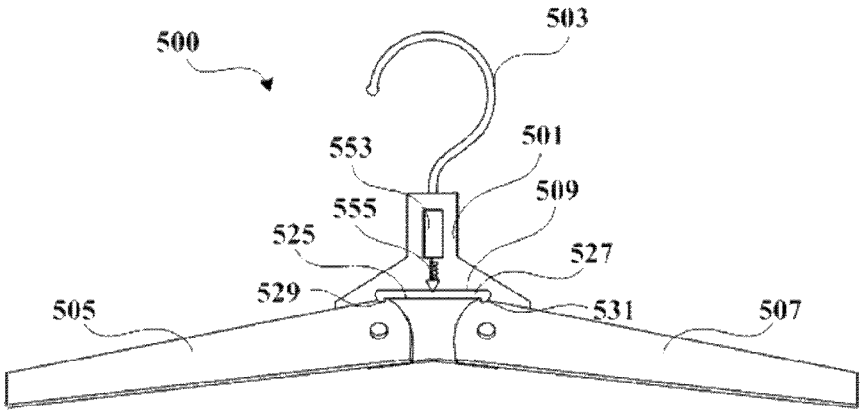
FIGS. 14 and 15 show perspective views of a hanger 500 according to an embodiment of the present disclosure.
Figure 15:
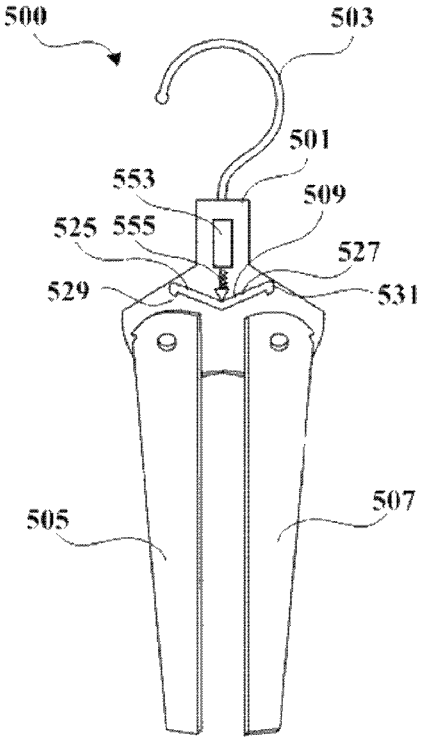

FIGS. 14 and 15 show perspective views of a hanger 500 according to an embodiment of the present disclosure. The hanger 500 shown in FIG. 14 is in an expanded mode, and the hanger 500 shown in FIG. 15 is in a retracted mode.

As shown in FIGS. 14 and 15, the hanger 500 has a supporting base 501, a hooking member 503, a pair of hanging members 505 and 507, a locking member 509 and an unlocking member 551. The locking member 509 has a pair of locking plates 525 and 527, which are biased by a pair of biasing elements (not shown), respectively.

The unlocking member 551 has a switch 553 and a spring 555. The switch 553 is movably mounted on the supporting base 501. The spring 555 resiliently couples the switch with the supporting base 501, such that the displacement of the switch 553 relative to the supporting base 501 is converted to driving force(s) for driving the locking member 509.

For example, one end of the spring 555 is connected to the switch 553, and the other end of the spring 555 is coupled or connected to the locking member 509, for example, via a conical tip. When the switch 553 is pushed downward and gets closer to the locking member 509, the spring 555 may apply driving forces to the locking member 509. The driving forces may overcome the biasing forces applied by the biasing elements 537 and 539 to release hooks 529 and 531 of locking plates 525 and 527 out of notches 521 and 523 of the hanging members 505 and 507. Then the hanger 500 is switched to the retracted mode as shown in FIG. 15. Moreover, the switch 553 may be pushed upward and get away from the locking plates 525 and 527. Then the driving forces may be removed from the locking plates 525 and 527. In this way, the biasing forces may restrict the movement of the locking plates 525 and 527 and the hanging member 505 and 507 once the hooks 529 and 531 are received within the respective notches of the hanging members 505 and 507, as shown in FIG. 14.

Figure 16:
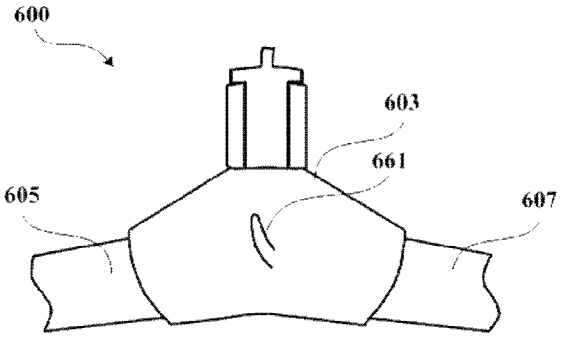
FIGS. 16 and 17 show an exterior view of a hanger 600 according to an embodiment of the present disclosure.

FIG. 16 shows an exterior view of a hanger 600 according to an embodiment of the present disclosure.

As shown in FIG. 16, the hanger 600 has a supporting base 601, a hooking member 603, a pair of hanging member 605 and 607, and a locking member (not shown). The locking member may have the structures described in the previous embodiments and some other suitable structures.

Figure 17:
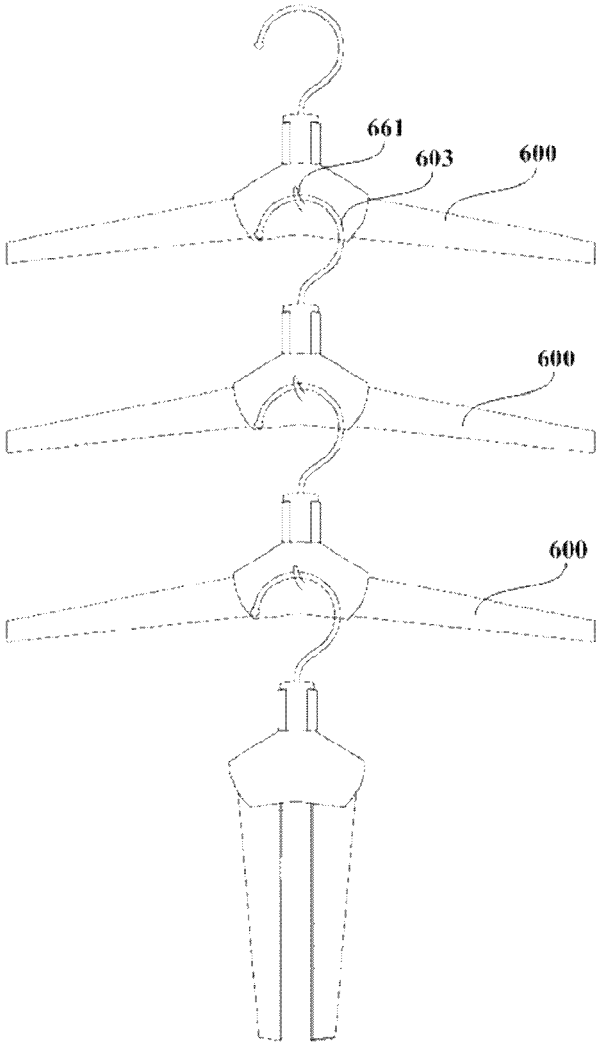

The hanger 600 further has a side hanging member 661, which is fixed on one side of the supporting base 601. In certain embodiments, the side hanging member 661 is positioned in the middle of the supporting base 601. The side hanging member 661 extends upward (in the direction shown in FIG. 16) from the supporting base 601. Thus, besides the hanging members 605 and 607, the side hanging member 661 forms another structure for hanging an object (not shown) such as accessories or the like. With the side hanging member 661, multiple hangers 600 may be strung together, as shown in FIG. 17. For example, the hooking member 603 of one hanger 600 can be hanged on the side hanging member 661 of another hanger 600. In this way, the hanger 600 may take up much less space when used for hanging objects, and therefore is more convenient for daily use.

While the present disclosure has been illustrated and described in detail in the drawings and foregoing description, such illustration and description are to be considered illustrative or exemplary and not restrictive; the present disclosure is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope. The scope and spirit of the present disclosure is defined by the appended claims.

I claim:

1. A hanger, comprising:

a supporting base;

a hooking members operably linked to the supporting base;

a pair of hanging members pivotally mounted to the supporting base and rotatable relative to the supporting base between an expanded mode and a retracted mode, wherein each of the pair of hanging members has an inner end received within the supporting base and a notch at the inner end;

a locking member operatively coupled to the pair of hanging members, wherein the locking member has switchably a locked position and an unlocked position, and wherein the pair of hanging members is in the expanded mode when the locking member is in the locked position, and is allowed to be in the retracted mode when the locking member is in the unlocked position, wherein the locking member comprises:

a pair of locking plates pivotally mounted to the supporting base, each of which has a hook operably inserted into the corresponding notch of the pair of hanging members to prevent the pair of hanging members from rotating relative to the supporting base; and a pair of biasing elements for applying biasing forces to the pair of locking plates to prevent the hooks from releasing from the notches, wherein each of the locking plates has a rotation axis separating two ends thereof, and wherein the hook is positioned at one end of the locking plate, and the biasing element is positioned at the other end of the locking plate.

2. The hanger of claim 1, wherein the inner end of each of the hanging members is at least partially shaped as a curved surface.

3. The hanger of claim 2, wherein each of the pair of hanging members has at least another notch at the curved surface of its inner end.

4. The hanger of claim 1, wherein the locking plates are configured to release the hooks from the notches in response to driving forces against the biasing forces when the locking member is switched from the locked position to the unlocked position.

5. The hanger of claim 1, further comprising:

an unlocking member operably coupled to the locking member, and configured to drive the locking member to switch from the locked position to the unlocked position.

6. The hanger of claim 5, wherein the unlocking member comprises:

a pair of unlocking plates operably engaged with the locking member such that their displacements relative to the locking member are converted to a driving force for driving the locking member.

7. The hanger of claim 6, wherein the unlocking member further comprises:

at least one spring for resiliently coupling the pair of unlocking plates.

8. The hanger of claim 5, the unlocking member further comprises:

a rotation member rotatably coupled to the supporting base, and configured to move relative to the locking member through its rotation relative to the supporting base, such that the displacement of the rotation member relative to the locking member is converted to a driving force for driving the locking member.

9. The hanger of claim 8, wherein the rotation member is threadly coupled to the supporting base.

10. The hanger of claim 5, wherein the unlocking member comprises:

a button resiliently coupled to the locking member, and configured to linearly move relative to the locking member, such that the displacement of the button is converted to a driving force for driving the locking member.

11. The hanger of claim 10, wherein the unlocking member comprises a spring for resiliently coupling the button with the locking member.

12. The hanger of claim 5, wherein the unlocking member comprises:

a switch movably mounted on the supporting base; and a spring for resiliently coupling the switch with the supporting base, such that the displacement of the switch relative to the supporting base is converted to a driving force for driving the locking member.

13. The hanger of claim 5, wherein the unlocking member comprises:

a button mounted on a lateral side of the supporting base and operably engaged with the locking member such that the displacement of the button relative to the locking member is converted to a driving force for driving the locking member.

14. The hanger of claim 1, further comprising:

a side hanging member fixed on a lateral side of the supporting base and configured to hang an object.

15. The hanger of claim 14, wherein the side hanging member is positioned in the middle of the supporting base.

* * * * *